US005865169A

United States Patent [19]

Lan et al.

[11] Patent Number: 5,865,169

[45] Date of Patent: Feb. 2, 1999

[54] SNORKEL HAVING IMPROVED INLET CAP

[75] Inventors: Shun-Nan Lan; Chih-Ban Hsu, both of Taipei Hsien, Taiwan

[73] Assignee: Pascadores Sports Inc., Taipei Hsien, Taiwan

[21] Appl. No.: 9,686

[22] Filed: Jan. 20, 1998

[51] Int. Cl.[6] ..... B63C 11/16

[52] U.S. Cl. ..... 128/201.11; 128/201.26; 128/201.27

[58] Field of Search ..... 128/201.11, 201.27, 128/201.26, 201.28, 200.29, 200.24

[56] References Cited

U.S. PATENT DOCUMENTS 5,529,057 6/1996 Ferrero et al. ..... 128/201.11

*Primary Examiner*—John G. Weiss
*Assistant Examiner*—Charles W. Anderson
*Attorney, Agent, or Firm*—Beveridge, DeGrandi, Weilacher & Young, LLP

[57] ABSTRACT

A snorkel having improved inlet cap comprising a hose and an inlet cap disposed onto the upper end of the hose. The inlet cap includes a vertical tube having a ventilating hole at a sidewall. The vertical tube further includes a projection that encloses the ventilating hole of the vertical tube. The projection has a hollow configuration and defines an upper and a lower opening, respectively. A covering lid is pivotally disposed onto the upper opening of the vertical tube while the upper opening of the vertical tube is still free to communicate with the outside. The covering lid further includes an extension that partially covers the upper opening of the projection such that the opening of the projection is partially enclosed. As a result, fresh air can be readily sucked into the hose from both the ventilating holes of the vertical tube as well as the opening of the vertical tube. As a result, the diver can be supplied with a great deal of fresh air. On the other hand since, the extension of the covering lid encloses part of the opening of the projection, a whitecap from all directions can be effectively blocked from entering the inlet cap.

4 Claims, 4 Drawing Sheets

SNORKEL HAVING IMPROVED INLET CAP

FIELD OF THE INVENTION

The present invention relates to a snorkel, and more particularly, to a snorkel having an improved inlet cap for surface float. The inlet cap allows a large quantity of air be sucked in while entry of the seawater can be effectively inhibited. The diver may enjoy a smooth breath and the diver will not be choked by the seawater.

DESCRIPTION OF THE PRIOR ART

Surface float has become a popular exercise for many people. The user simply requires a mask and a snorkel that is disposed within the mouth to conduct this popular exercise. The snorkel has a certain length such that when the diver dives in the water, the inlet or top end of the snorkel may project over the water surface. As a result, the user may breathe fresh air through the snorkel while enjoying the underwater scene.

The conventional snorkel generally comprises a hose defining an inlet and a mouthpiece. In use, the mouthpiece of the hose is disposed within the mouth of the user and the inlet projects over the water surface for air communication. By this arrangement, the user may get fresh air continuously through the snorkel. As a result, the diver may proceed with the underwater activity and this activity will not be interrupted as the diver floats on the water.

Even the snorkel provides a conduit for air supply when the diver dives, the whitecap of a wave resulting from wind may also enter the snorkel through the inlet. Once the whitecap or seawater enters the inlet, the diver will be choked by the seawater. In order to prevent the choking, the diver is advised not to dive deeply. Accordingly, the inlet of the snorkel will not be close to the sea level. However, the diver has no idea about the distance between the inlet and the sea level during his/her diving. Consequently, choking or drinking seawater is still inevitable.

In order to prevent the whitecap or seawater from entering the snorkel through the inlet, a cap (b) is provided on the inlet of the hose (a). As shown in FIG. 4, the cap (b) is provided with a check valve (c) and the sidewall of the cap (b) is provided with a plurality of vents (b1). By this arrangement, the fresh air can be sucked into the hose (a) through the vents (b1). On the other hand, the seawater brought in can be drained out through the discharging port located at the lower end of the hose (a). Nevertheless, the vent (b1) is the only inlet for air supply, and the diver can not be supplied with sufficient fresh air. Furthermore, when the wave is high, a large quantity of whitecap may enter the hose (a) through the vents (b1). As a result, the diver will be choked and even drink a lot of seawater.

SUMMARY OF THE INVENTION

It is the objective of this invention to provide a snorkel having an improved inlet cap for surface float. The inlet cap allows large quantity of air to be sucked in while entry of the seawater can be effectively inhibited. The diver may enjoy a smooth breath and the diver will not be choked by the seawater.

In order to achieve the objective set forth, a snorkel having an improved inlet cap comprising a hose and an inlet cap is provided that is disposed onto the upper end of the hose. The inlet cap includes a vertical tube having a ventilating hole at the sidewall. The vertical tube further includes a projection that encloses the ventilating hole of the vertical tube. The projection has a hollow configuration and defines an upper and a lower opening, respectively. A covering lid is pivotally disposed onto the upper opening of the vertical tube while the upper opening of the vertical tube is still free to communicate with the outside. The covering lid further includes an extension that covers partially the upper opening of the projection such that the opening of the projection is partially enclosed.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
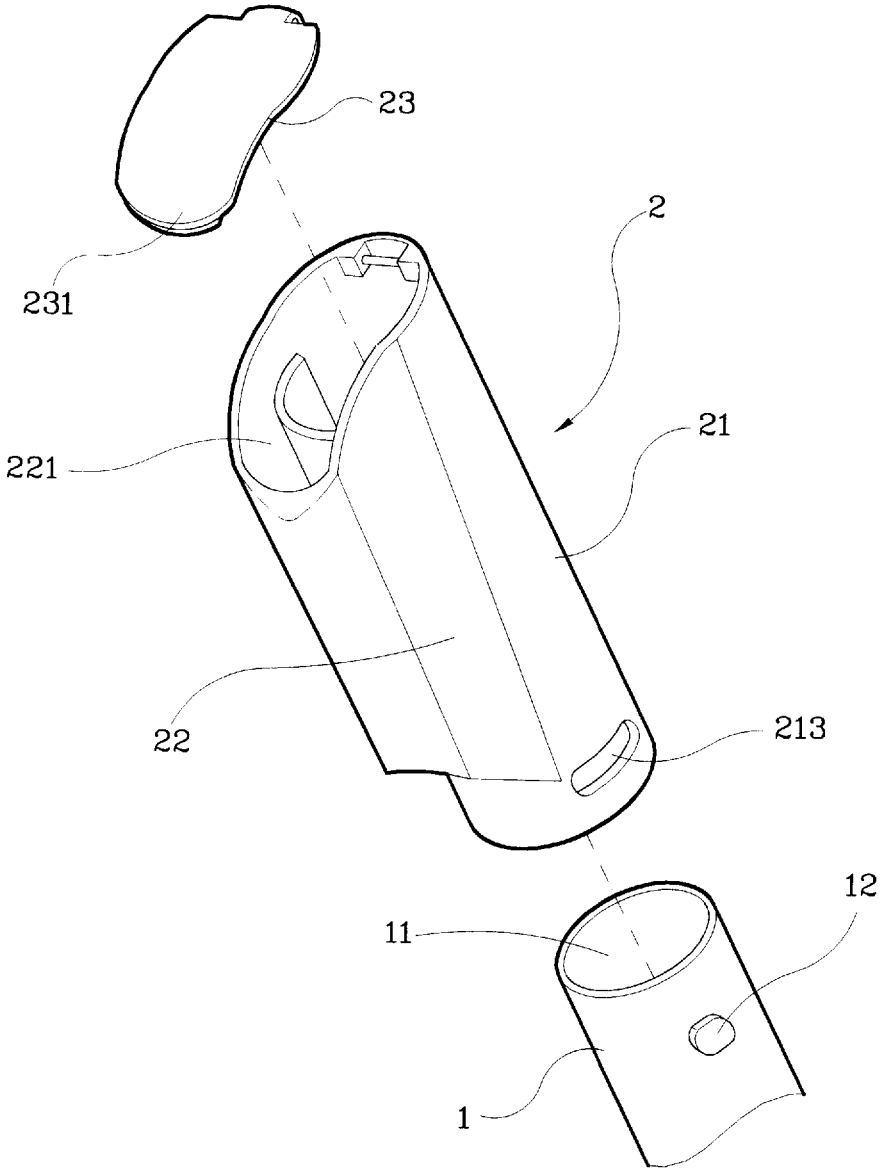
FIG. 1 is an exploded view of the snorkel and the inlet cap made according to the present invention.
Figure 2:
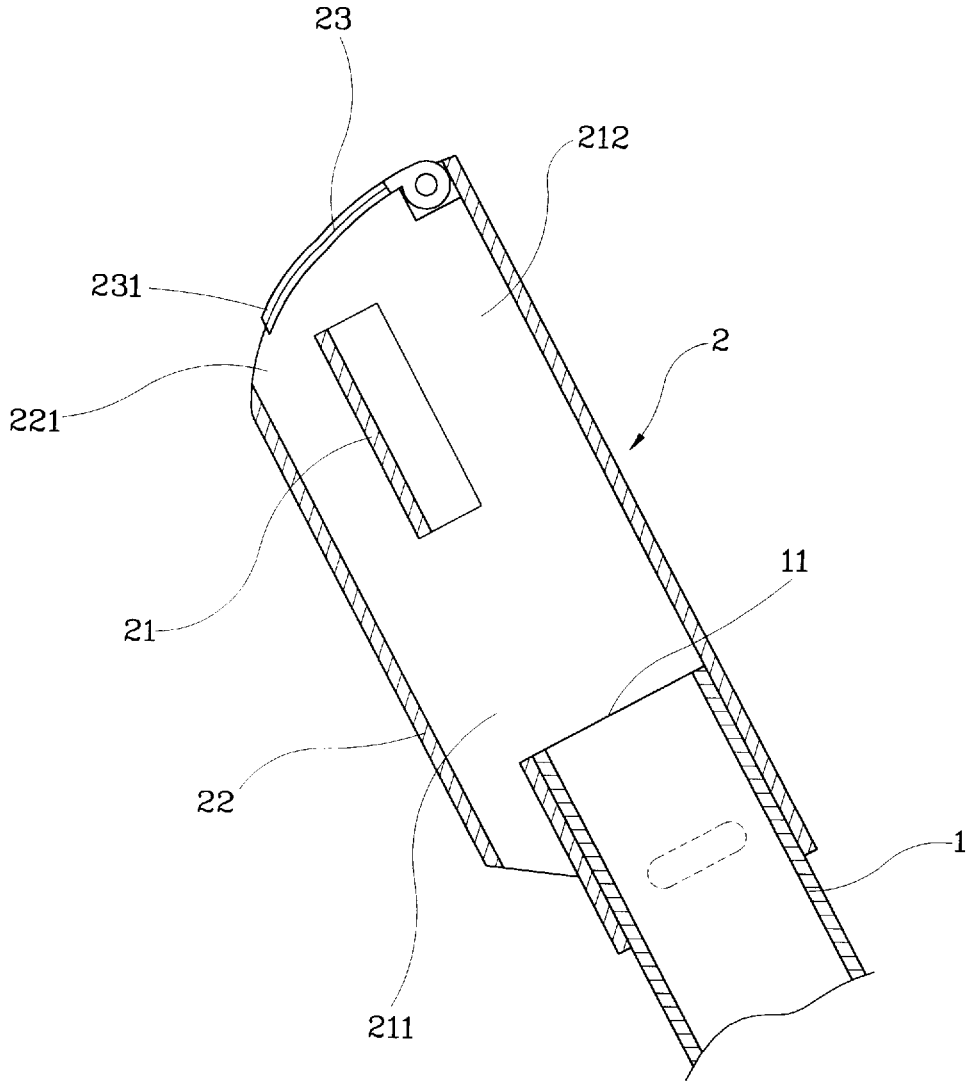
FIG. 2 is a cross sectional view showing the connection between the snorkel and the inlet cap shown in FIG. 1.
Figure 3:
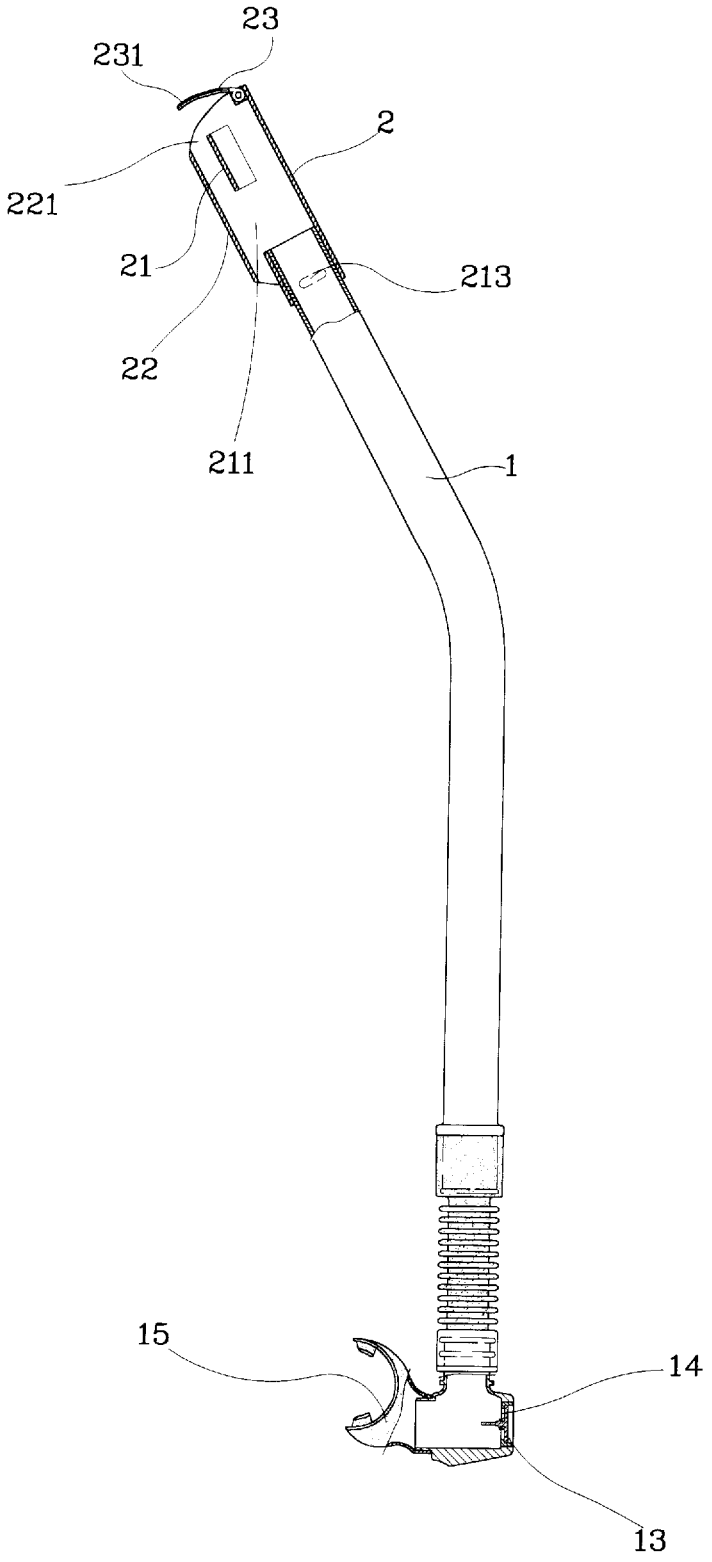
FIG. 3 is a cross sectional view of the snorkel made according to the present invention.
Figure 4:
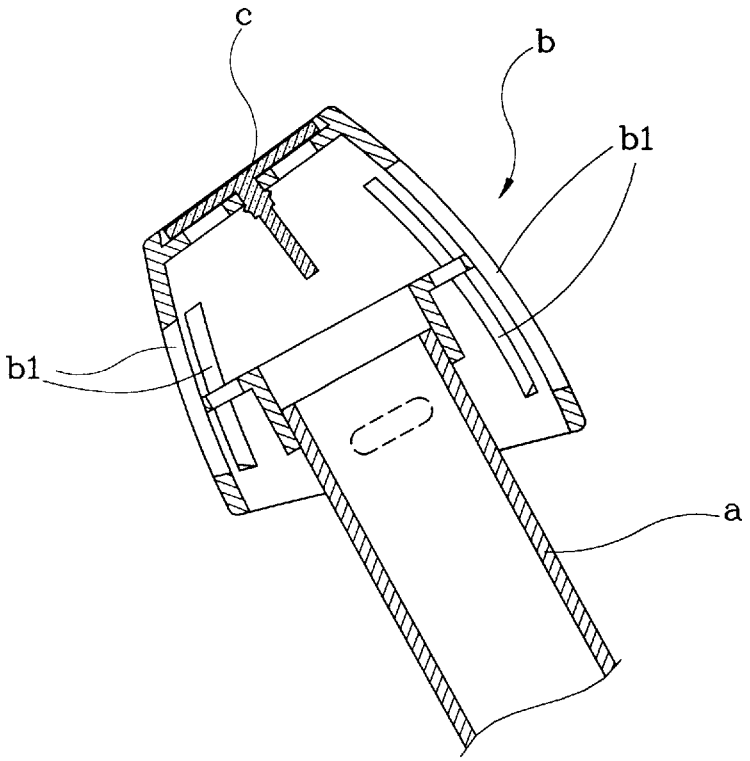
FIG. 4 (PRIOR ART)
FIG. 4 is a cross sectional view of a conventional snorkel.

Referring to FIGS. 1 to 3, the snorkel having improved inlet cap generally comprises a hose 1 and an inlet cap 2 is disposed at the top end of the hose 1.

The hose 1 defines an opening 11 at the upper end. A fastening button 12 is disposed at the outer surface of the hose 1 and that is adjacent to the opening 11. The lower end of the hose 1 is provided with a discharging port 14 having a check valve 13 thereof. A mouthpiece 15 is disposed on the lower end of the lower end of the hose 1 and is opposite to the discharging port 14.

The inlet cap 2 includes a vertical tube 21 that has a ventilating hole 211 at the sidewall. The vertical tube 21 further includes a projection 22 that encloses the opening 211. The projection 22 has a hollow configuration and defines an opening 221 at top. The projection 22 serves a barrier to prevent the whitecap from directly entering the ventilating hole 211 of the vertical tube 21 and the whitecap in turn will enter the hose 1. The opening 212 of the vertical tube 21 is pivotally mounted with a covering lid 23 to prevent the whitecap or seawater from entering the hose 1. The opening 212 of the vertical tube 21 is free to communicate with the outside. The covering lid 23 further includes an extension 231 that covers part of the opening 221 of the projection 22. Accordingly, the opening 221 of the projection 22 will not be completely enclosed when the covering lid 23 is seated. The lower end of the vertical tube 21 is provided with a retaining recess 213 corresponding to the fastening button 12 of the hose 1. When the inlet cap 2 is attached to the hose 1, the retaining recess 213 may readily seated onto the fastening button 12.

When the snorkel made according to the present invention is in use, the fresh air can be readily sucked into the hose 1 from both the ventilating holes 211 of the vertical tube 21 as well as the opening 212 of the vertical tube 21. As a result, the diver can be supplied with a great deal of fresh air. On the other hand, the extension 231 of the covering lid 23 may enclose part of the opening 221 of the projection 22, the whitecap from all directions can be effectively blocked. As a result, the whitecap and/or seawater will not enter into the hose 1 through the opening 211 of the vertical tube 21. Consequently, the diver will not be choked by the whitecap and/or seawater.

Even the whitecap and/or seawater is too large to come into the hose 1, the seawater can be drained from two channels. Firstly, the seawater can be drained out through the discharging port 14. Secondly, the seawater can be discharged from the ventilating hole 211 when the diver breathes out. In doing this, the covering lid 23 will be pushed upward to let the seawater directly be blown out from the opening 212 of the vertical tube 21.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A snorkel having an improved inlet cap and comprising a hoses an inlet cap disposed onto an upper end of the hose, said inlet cap including a vertical tube having a ventilating hole at a sidewall, said vertical tube further including a projection enclosing said ventilating hole of said vertical tube, said projection having a hollow configuration and defining upper and lower openings, respectively, a covering lid pivotally disposed onto an upper opening of said vertical tube including an extension partially covering and enclosing the upper opening of said projection.

2. The snorkel having an improved inlet cap as defined in claim 1, wherein said lower opening of said projection is below the upper end of said hose.

3. The snorkel having an improved inlet cap as defined in claim 1, further comprising a fastening button on a surface of said hose, said inlet cap provided with a retaining recess engaging said fastening button and securing said inlet cap to said hose.

4. The snorkel having an improved inlet cap as defined in claim 2, further comprising a fastening button on a surface of said hose, said inlet cap provided with a retaining recess engaging said fastening button and securing said inlet cap to said hose.

* * * * *